US012546175B1

(12) United States Patent
Dave et al.

(10) Patent No.: US 12,546,175 B1
(45) Date of Patent: Feb. 10, 2026

(54) PRESSURE INTENSIFIER MODULE FOR ADDITIONAL SETTING FORCE IN A RETRIEVABLE BRIDGE PLUG

(71) Applicant: Halliburton Energy Services, Inc., Houston, TX (US)

(72) Inventors: Jalpan P. Dave, Singapore (SG); Anthony Phan, Singapore (SG); Scott Elliott Wallace, Singapore (SG); Andrew Wei Xue Toh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 19/040,555

(22) Filed: Jan. 29, 2025

(51) Int. Cl.
*E21B 23/04* (2006.01)
*E21B 33/128* (2006.01)

(52) U.S. Cl.
CPC ..... *E21B 23/042* (2020.05); *E21B 33/1285* (2013.01)

(58) Field of Classification Search
CPC ..... E21B 23/042; E21B 33/1285
See application file for complete search history.

(56) References Cited

U.S. PATENT DOCUMENTS 4,109,940 A 8/1978 Reneau
4,545,433 A 10/1985 Wambaugh
5,429,036 A 7/1995 Latos
5,893,413 A * 4/1999 Lembcke ..... E21B 23/0411 166/321
6,073,708 A 6/2000 Brown et al.
6,289,998 B1 9/2001 Krueger et al.
(Continued)

FOREIGN PATENT DOCUMENTS

BR 112021007440 7/2021
GB 2552994 2/2018
(Continued)

OTHER PUBLICATIONS

Bartnicki, et al., "The Research of Hydraulic Pressure Intensifier for Use in Electric Drive System", IEEE Access, 2018, 2018, 6 pages.
(Continued)

*Primary Examiner* — D. Andrews
(74) *Attorney, Agent, or Firm* — DeLizio, Peacock, Lewin & Guerra LLP

(57) ABSTRACT

Some implementations include an apparatus configured for use in a wellbore drilled through one or more subsurface formations. The apparatus may comprise one or more pressure intensifier modules configured to increase an applied force of a downhole power unit (DPU) in setting a downhole tool in the wellbore, each pressure intensifier module including a movable input device configured to provide an input force from the DPU and a pressure intensifier piston having a first portion of a first contact area and a second portion of a second, smaller contact area, wherein the pressure intensifier piston is coupled to the movable input device by a force-dependent coupling device. The apparatus may also include a setting piston configured to provide a setting force to one or more components of the downhole tool, wherein the setting force is generated, at least in part, by the pressure intensifier piston.

20 Claims, 4 Drawing Sheets

(56) References Cited

U.S. PATENT DOCUMENTS

| | | | | |
|---|---|---|---|---|
| 7,000,705 | B2 | 2/2006 | Buyers et al. | |
| 9,383,029 | B2 | 7/2016 | Scott | |
| 9,551,200 | B2 | 1/2017 | Read et al. | |
| 9,638,034 | B2 | 5/2017 | Chen et al. | |
| 9,771,797 | B2 | 9/2017 | Hemsing | |
| 10,066,466 | B2 | 9/2018 | Radtke | |
| 10,132,135 | B2 | 11/2018 | Gaude | |
| 2011/0073328 | A1* | 3/2011 | Clemens | E21B 23/01 166/182 |
| 2011/0232474 | A1 | 9/2011 | Geiger | |
| 2014/0190708 | A1 | 7/2014 | Hallundbaek | |
| 2015/0112599 | A1 | 4/2015 | Proett et al. | |
| 2015/0316170 | A1 | 11/2015 | Scott | |
| 2017/0016293 | A1* | 1/2017 | Thomas | E21B 23/01 |
| 2018/0030797 | A1 | 2/2018 | Sommer | |
| 2018/0080303 | A1 | 3/2018 | Radtke et al. | |
| 2020/0284140 | A1 | 9/2020 | Jones et al. | |
| 2021/0047893 | A1 | 2/2021 | Hrupp et al. | |
| 2022/0090457 | A1 | 3/2022 | Tanguy et al. | |
| 2024/0328307 | A1 | 10/2024 | Kallehbasti | |
| 2025/0223882 | A1* | 7/2025 | Dave | E21B 34/10 |

FOREIGN PATENT DOCUMENTS

| | | |
|---|---|---|
| WO | 1999035365 | 7/1999 |
| WO | 2016051180 | 4/2016 |

OTHER PUBLICATIONS

"PCT Application No. PCT/US2025/016938 International Search Report and Written Opinion", Oct. 22, 2025, 11 pages.

* cited by examiner

PRESSURE INTENSIFIER MODULE FOR ADDITIONAL SETTING FORCE IN A RETRIEVABLE BRIDGE PLUG

TECHNICAL FIELD

The disclosure generally relates to the field of downhole tools configured for use in a wellbore drilled through one or more subsurface formations, and more specifically, to the setting of downhole tools in the wellbore.

BACKGROUND

Bridge plugs may be set with downhole power units (DPUs). DPUs may enable the setting of removable bridge plugs and other downhole equipment by electromechanical means or by using explosives. DPUs may be designed for a given max setting load. However, some bridge plugs may require additional setting force for a given application, and designing new DPUs may be a complex and expensive endeavor. Therefore, it may be advantageous to obtain additional setting force on bridge plugs without requiring a new DPU or major re-design of the plug. A bridge plug is a non-limiting example of a downhole tool set using a DPU. One skilled in the art will recognize that the concepts described herein can be applied to any downhole tool that is set using a DPU.

BRIEF DESCRIPTION OF THE DRAWINGS

Implementations of the disclosure may be better understood by referencing the accompanying drawings.

FIGS. 1-4 and the operations described herein are examples meant to aid in understanding example implementations and should not be used to limit the potential implementations or limit the scope of the claims. Some implementations may perform additional operations, fewer operations, operations in parallel or in a different order, and some operations differently.

The description that follows includes example systems, methods, techniques, and program flows that embody implementations of the disclosure. However, it is understood that this disclosure may be practiced without these specific details. In other instances, well-known instruction instances, protocols, structures, and techniques have not been shown in detail in order not to obfuscate the description.

Overview

To address the above challenges, a pressure intensifier module may be retrofit onto an existing bridge plug. The force from the DPU may be transmitted into the elements and slips via the intensifier module. The pressure intensifier module may activate after a threshold force is exceeded. The amplified force may then be transmitted to the elements via a locking device, such as lock rings, which may lock in the setting force. Rather than using the pressure intensifier module within a separate setting tool, the pressure intensifier module may be assembled and used on the bridge plug itself, providing a cost-effective solution. Bridge plug designs using this pressure intensifier module may be configured for use in challenging applications without having to re-design the DPU and without setting load being a design constraint.

Example Plug Assembly

Figure 1:
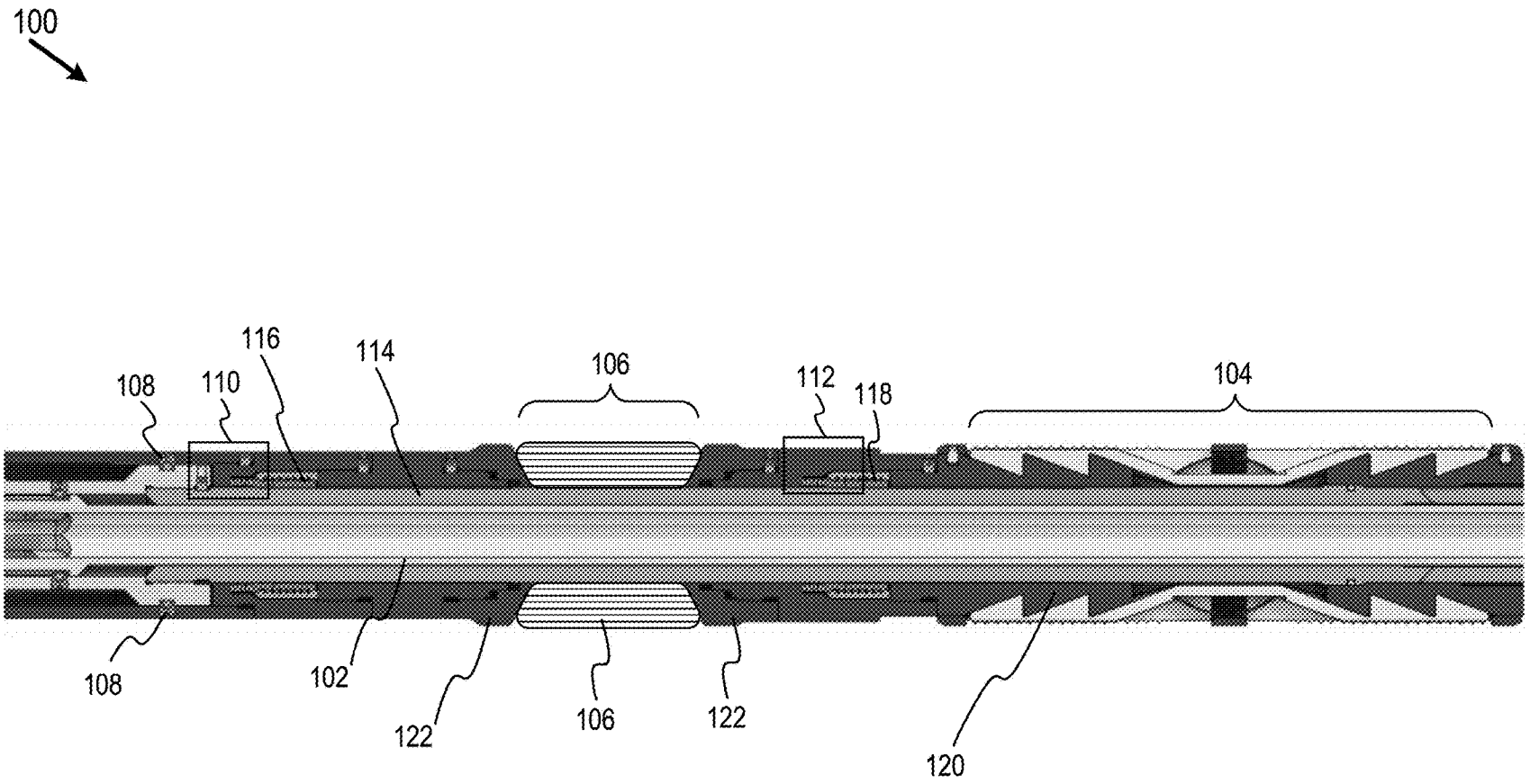
FIG. 1 is an illustration depicting an example retrievable bridge plug assembly, according to some implementations.

FIG. 1 is an illustration depicting an example retrievable bridge plug assembly 100, according to some implementations. The retrievable bridge plug assembly 100 includes an inner core rod 102, slips 104, sealing elements 106, shear pins 108, a first placement area 110, a second placement area 112, a mandrel 114, a first lock ring 116, a second lock ring 118, a setting device 120, and a setting device 122. In some implementations, the sealing elements 106 may be comprised of an elastomeric compound such as rubber. When the sealing elements 106 are squeezed by the setting device 122, the sealing elements 106 may bulge radially outward to form a seal with an inner surface of a tubular, such as a joint of casing or tubing. The slips 104 may include a plurality of teeth and/or ridges configured to bite into an inner surface of a tubular, such as a joint of casing or tubing. The slips 104 may be configured to maintain an anchoring load while the sealing elements 106, once engaged, are configured to form a pressure and/or fluidic seal between the retrievable bridge plug assembly 100 and a tubing string, casing string, a mandrel, other tubulars, etc. in a wellbore. Various components such as the setting devices 120 and 122, the slips 104, etc. may be configured as sleeves placed over the mandrel 114 to create one or more piston areas during the setting of the retrievable bridge plug assembly 100.

When setting the retrievable bridge plug assembly 100, a DPU positioned uphole of the retrievable bridge plug assembly 100 may be conveyed into a wellbore via wireline, slickline, etc. The DPU may use power conveyed from a surface power unit or from batteries within the DPU to power at least one of a DPU control unit, a downhole motor, etc. The DPU motor may provide a rotational force to a worm gear, and the worm gear may turn the rotational force into a linear force used to pull upwards on the inner core rod 102. After a threshold force has been reached, the shear pins 108 may be sheared, and a setting process of the retrievable bridge plug assembly 100 may be initiated. The DPU may pull upward (as shown, the DPU may pull to the left) on the inner core rod 102, and this may translate the setting devices 120 and 122 to the right, as shown. As the inner core rod 102, setting device 120, and setting device 122 are moved via the DPU, the sealing elements 106 and slips 104 are pushed outward to contact a casing or tubing. Each of the lock rings 116, 118 may include a plurality of grooves or teeth which ratchet to the right to prevent applied force from dissipating. For example, the lock ring 116 may lock in a setting force on the sealing elements 106, and the lock ring 118 may lock in a setting force on the slips 104. In some implementations, each of the lock rings 116, 118 may include one or more Belleville washers configured to reduce a backlash through their respective lock ring during the setting process.

DPUs may be configured in various sizes and for various load ratings. Accordingly, a DPU may be configured to exert a specific and predictable setting force on the sealing elements 106 and slips 104. For example, a DPU rated for 40,000 pounds per square inch (psi) may be configured to provide 40,000 psi of force on the slips 104 and sealing elements 106 to set the retrievable bridge plug assembly 100. However, some applications may require additional setting force at the slips 104 and/or sealing elements 106 which may not be achievable by a selected DPU. Rather than swapping out or redesigning the DPU, one or more pressure intensifier modules, described with additional detail in FIG. 2, may be placed in at least the first placement area 110 and second placement area 112 of the retrievable bridge plug assembly 100 to increase the setting forces provided by the DPU. Placing one or more pressure intensifier modules in or proximate to the first placement area 110 may increase a setting force applied to the sealing elements 106, and placing one or more pressure intensifier modules in or proximate to the second placement area 112 may increase a setting force applied to the slips 104. This may increase the surface contact pressure of the sealing elements 106 and the anchoring load supported by the slips 104, respectively. A pressure intensifier module may be installed on either end of the slips 104, the sealing elements 106, etc., as needed to provide additional setting forces.

Example Pressure Intensifier Module

Figure 2A:
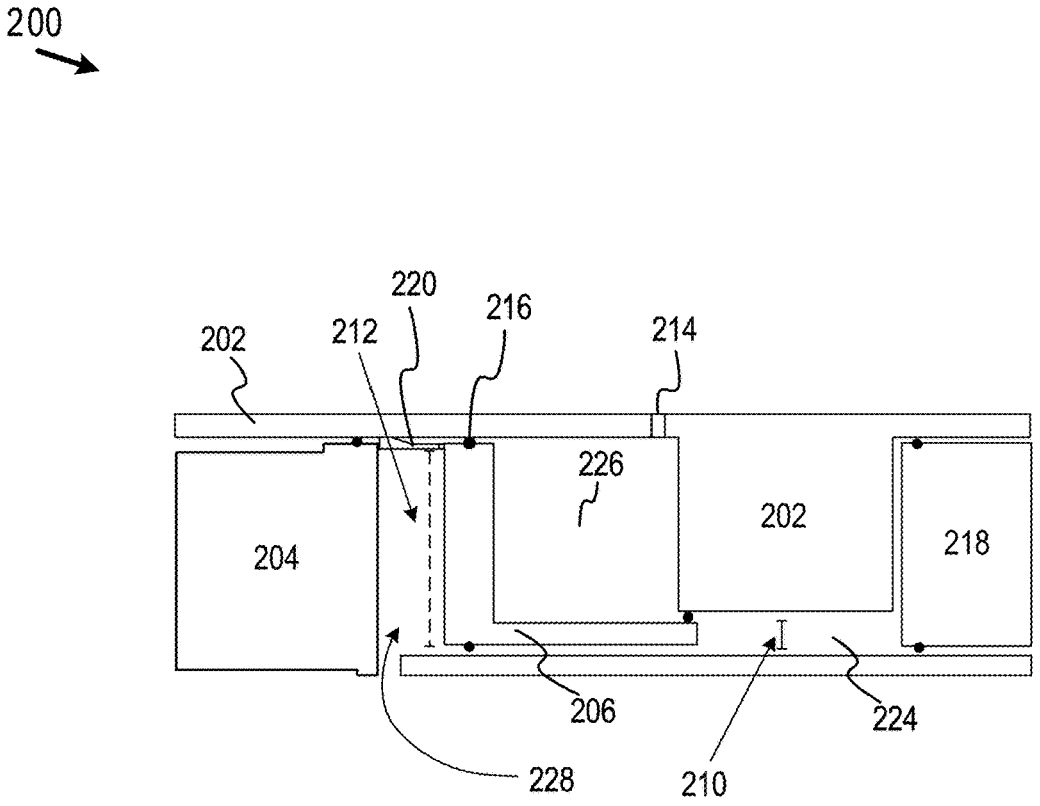
FIGS. 2A-2B are illustrations depicting an example pressure intensifier module for use with the retrievable bridge plug assembly of FIG. 1, according to some implementations.
Figure 2B:
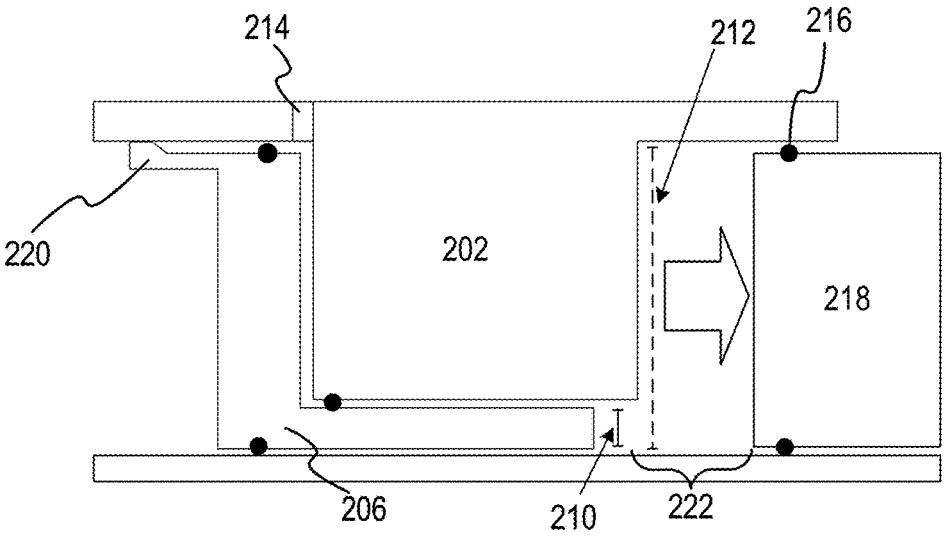

FIGS. 2A-2B are illustrations depicting an example pressure intensifier module 200 for use with the retrievable bridge plug assembly of FIG. 1, according to some implementations. The pressure intensifier module 200 includes a movable cylinder 202, a bridge plug component 204, an intensifier piston 206, a contact area 210, a contact area 212, a pressure equalization port 214, an O-ring 216, a setting piston 218, a force-dependent coupling device 220, a region 222, and a pressurization bore 224, a region 226, and a region 228. In some implementations, the force-dependent coupling device 220 may include a shear screw, a shear pin, or any other shearing device. However, other implementations of the force-dependent coupling device 220 may include pressure activated devices such as a rupture disc positioned in the pressurization bore 224, a check valve, a collet, or any other fastening mechanism.

The bridge plug component 204 may be part of the retrievable bridge plug and may be positioned adjacent to the intensifier piston 206. Applied load from the DPU may be transmitted through the bridge plug component 204 and into the intensifier piston 206. Initially, before a threshold force is met, force from the DPU may be transmitted into the movable cylinder 202, into the setting piston 218, and into the slips or sealing elements without any relative movement. When the threshold force is exceeded, the intensifier piston 206 and setting piston 218 may move while the movable cylinder 202 remains stationary.

The pressurization bore 224 may include an incompressible medium such as an incompressible fluid which may be moved into the region 222 to hydraulically pressurize the region 222. This incompressible fluid may be pre-filled and pressurized at the surface of the well or alternatively, a one-way check valve may allow wellbore fluid to enter and equalize pressure in the pressurization bore 224 as the tool is being run downhole. Such a check valve may be placed through the movable cylinder 202, for example. In some implementations, a compressible fluid may be used as well. For example, a compressible fluid may be used, and a floating piston positioned through the pressure equalization port 214 may be used to equalize pressure within the pressure intensifier module 200 and the wellbore as the tool is being run downhole. Using a compressible fluid may have the advantage of applying additional setting force during a thermal cooldown.

In some implementations, the movable cylinder 202 may include the pressure equalization port 214. The pressure equalization port 214 may equalize a pressure within the pressure intensifier module 200 with an external pressure so that the area between the movable cylinder 202 and intensifier piston 206 does not become an atmospheric trap during run-in. The pressure equalization port 214 may allow downhole fluid to enter the pressure intensifier module 200 such that the pressure in the region 226 equalizes with the pressure in the region 228.

In FIG. 2A, the movable cylinder 202 and intensifier piston 206 may be coupled via a force-dependent coupling device 220. The force-dependent coupling device 220 may be configured to selectively engage based on an applied force. Below a threshold force, the intensifier piston 206 and movable cylinder 202 may move axially as a single component. Therefore, a mechanical load supplied by the DPU may be transferred to the setting piston 218 directly—i.e., the applied force from the DPU may be approximately equal (within 5% error) to the setting force transferred to the setting piston 218 below the threshold force. In some implementations, the threshold force to decouple the intensifier piston 206 and movable cylinder 202 (i.e., to disengage the force-dependent coupling device 220) may be higher than the threshold force required to initiate the setting process of the retrievable bridge plug assembly 100.

In FIG. 2B, an input force supplied by the DPU may be multiplied by the pressure intensifier module 200. When the mechanical load increases towards the end of the setting sequence of the retrievable bridge plug assembly 100, the force-dependent coupling device 220 may disengage through shearing, rupturing, etc. when the threshold force has been reached. Accordingly, the movable cylinder 202 and intensifier piston 206 may decouple, activating the pressure intensifier module 200 over a remainder of the stroke length of the bridge plug component 204. The applied force from the DPU may axially translate the intensifier piston 206, which may now move freely, from a first position to a second position. While the applied force from the DPU is applied to the second portion of the intensifier piston 206 having the contact area 212, the applied force may be multiplied via the smaller contact area of the intensifier piston 206 through the pressurization bore 224 as fluid enters the region 222. For example, the contact area 212 may correspond to a contact surface area of 3 square inches. Following this example, the contact area 210 may correspond to a contact surface area of 1 square inch. If the DPU applies a force of 20,000 pounds force (lbf) to the intensifier piston 206 across the contact area 212 (in this example, corresponding to a pressure of 20,000 psi), this force may be multiplied across the larger contact area 210. This force applied from the DPU may generate a hydraulic force, and a fluid or similar medium may contact the intensifier piston 206 across the contact area 212 to move the intensifier piston 206. A region 222 may also be of similar height (e.g., within 0.5 inches) to that of the contact area 212, as shown in FIG. 2B.

A portion of the intensifier piston 206 may be pushed through the pressurization bore 224. This may displace the fluid within the pressurization bore 224 into the region 222, pressurizing the region 222. As the contact area 210 of the pressurization bore 224 expands into the contact area 212 of the region 222, so too will the force applied to the setting piston 218. In the above example, a setting force of 60,000 lbf may be exerted on the setting piston 218. The setting piston 218 may transmit the intensified load into at least one of the slips 104, sealing elements 106, etc. via the lock rings 116, 118 which may be configured to maintain the amplified setting force.

Other contact area ratios in addition to the above example may also be possible. The stroke length of the intensifier piston 206 may be adjusted based on the contact area ratio. The size of the pressure intensifier module 200 may therefore be tailored depending on the setting forces required and the size limitations of an installation location. Each pressure intensifier module 200 may be installed in a location such that it does not hinder the operation of the retrievable bridge plug assembly 100, nor interfere with the operation of the retrievable bridge plug assembly 100 when below the threshold force of the force-dependent coupling device 220. The threshold force of the force-dependent coupling device 220 may be configured such that the pressure intensifier module 200 is activated near the end of the setting sequence as the bridge plug component 204 is finishing its stroke. This may provide extra packing to the sealing elements 106 or slips 104, and the stroke of the intensifier piston 206 may be shorter in comparison than if the pressure intensifier module 200 was configured to activate near the beginning of the setting sequence. However, the threshold force of the force-dependent coupling device 220 may be tailored to various settings as desired.

The additional setting force supplied by the pressure intensifier module 200, as shown in FIG. 2B, may be captured by the lock rings 116, 118 of FIG. 1. The lock rings may be placed such that the amplified setting force(s) supplied by the pressure intensifier module 200 retain an anchoring load on the slips 104 (which may be transferred into a casing or tubing joint) or a contact surface pressure on the sealing elements 106 (which may be transferred into a casing or tubing joint). In some implementations, the movable cylinder 202 may include one or more grooves to prevent the intensifier piston 206 from moving back and releasing pressure from the region 222. For example, the force-dependent coupling device 220 may include a collet including a fin configured to fit within the one or more grooves. Each groove may include a vertical face to prevent backward movement (i.e., to the left) of the collet and a gradually sloped face to which the fin may move beyond. For example, upon exceeding the threshold force and activating the pressure intensifier module 200, the fin may pop out of a first groove and move (as shown, to the right) with the intensifier piston 206. The fin may lock into a second groove at the end of the stroke. The intensifier piston 206 may be locked into the second position to maintain the pressure within the region 222. However, other locking devices, such as a lock ring, may also be used to secure the intensifier piston 206 in place at the end of the stroke. In some implementations, a check valve may be positioned such that fluid flow into the region 222 may not travel back through the pressurization bore 224, thus locking in the amplified pressure. In some implementations, the fluid flow into the region 222 may include an incompressible fluid or a compressible fluid. An incompressible fluid may minimize the stroke length of the intensifier piston 206 compared to a compressible fluid, but the longer stroke length achieved by using a compressible fluid may allow for additional energization on the sealing elements should the sealing element shrink due to a thermal effect.

Elastomeric sealing elements, such as the sealing elements 106, may experience volume contracts during temperature reductions. For example, the retrievable bridge plug assembly 100 may be set in a wellbore environment having a temperature of 275° F. Pressure reversals may lower the temperature around the retrievable bridge plug assembly 100 to 150° F., for example. Such a large temperature drop may shrink the sealing elements and risk losing the seal with the casing or tubing. However, the trapped pressure within the region 222 may provide additional squeezing capability should the sealing elements 106 experience thermal contraction during cooldown. The setting piston 218 may move to the right, and the lock rings 116, 118 may latch into a further/additional tooth. Therefore, the surface contact pressure may be maintained on the sealing elements 106 at lower temperatures, and the pressure intensifier module 200 may allow for even tighter seals should the sealing elements thermally expand later. The trapped pressure within the region 222 may provide enhanced setting forces for the life of the tool, regardless of downhole temperature. As described above, using a compressible medium (e.g., a gas, a condensate, etc.) rather than a fluid considered to be an incompressible fluid (e.g., water, oil, etc.) may place additional pressure on the sealing elements during a thermal cooldown.

Example Wireline System

Figure 3:
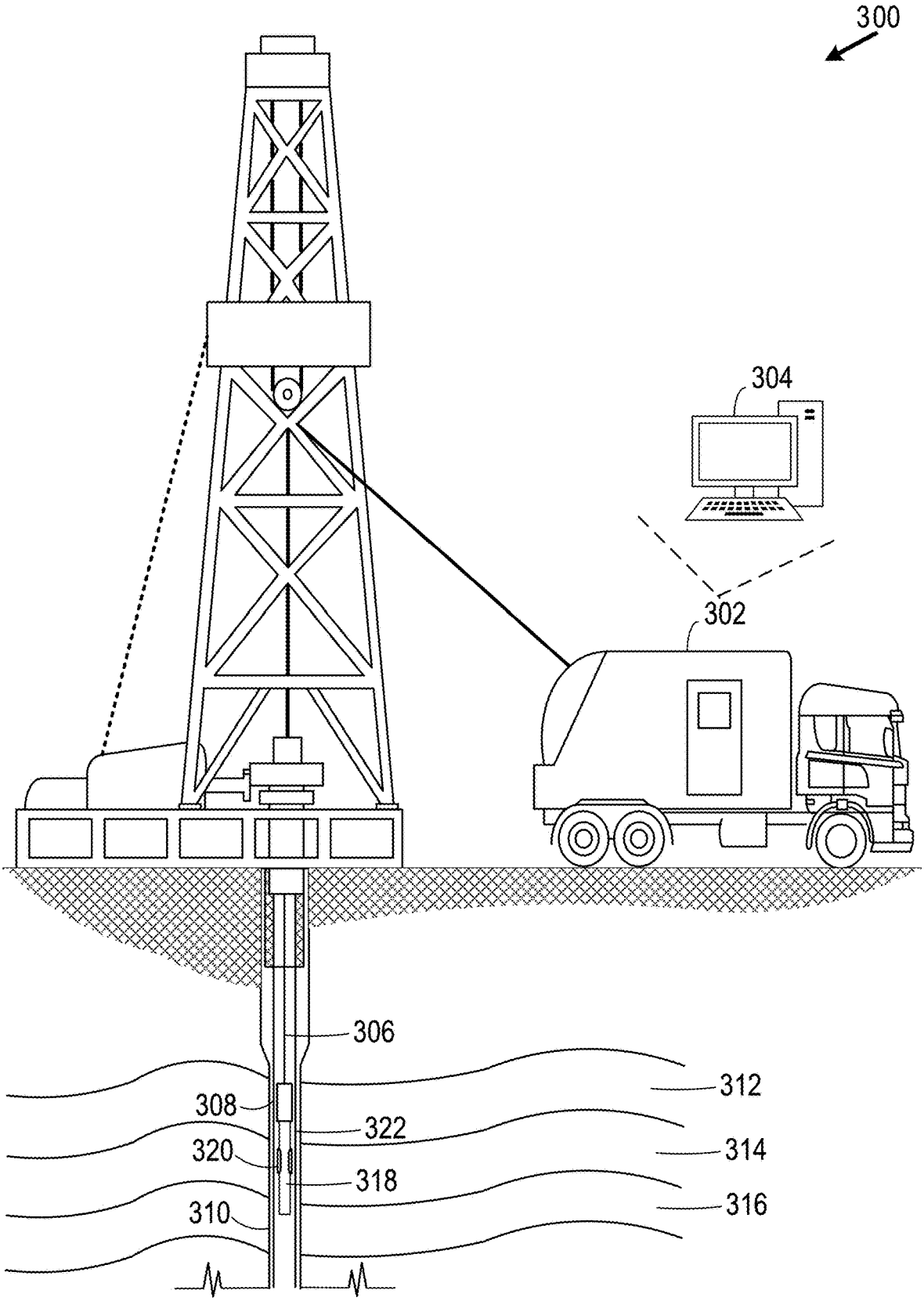
FIG. 3 is an illustration depicting an example wireline system having a downhole power unit, according to some implementations.

FIG. 3 is an illustration depicting an example wireline system 300 having a downhole power unit, according to some implementations. The wireline system 300 may include a wireline facility 302, a control system 304, a conveyance medium 306, a downhole power unit (DPU) 308, a downhole tool 318 having sealing elements 320, and a tubular 322. As depicted, the tubular 322 may comprise one or more joints of a tubing string. However, some implementations of the tubular 322 may also comprise one or more joints of a casing string, or any other tubular positioned in the wellbore 310. The wireline system 300 may be used in an illustrative logging environment with a drill string removed, in accordance with some implementations of the present disclosure. For example, the wireline system 300 may be conveyed into a wellbore 310 drilled through subsurface formations 312, 314, 316, etc. The control system 304 may include a computer system housed within the wireline facility 302, remote to the well site, etc. The control system 304 may be used to guide at least a portion of a wireline operation using the wireline system 300.

While depicted for use within an onshore well, the wireline system 300 may also be implemented in an offshore or subsea environment. The wireline facility 302, while depicted as a vehicle/mobile configuration in FIG. 3, may include any other suitable structure. The wireline facility 302 may collect measurements from the downhole tool 318 and/or DPU 308. The wireline facility 302 may include computing facilities for controlling, processing, or storing the measurements gathered from the components downhole. The computing facilities may be communicatively coupled to the DPU 308 and downhole tool 318 by way of the conveyance medium 306 and may operate similarly to the control system 304.

In some implementations, the control system 304 may be positioned at the surface, in the wellbore 310 (e.g., in the DPU 308 and/or as part of the downhole tool 318) or both. For example, at least a portion of the processing may occur downhole, and a portion may occur at the surface. The control system 304 may include a control system or a control algorithm. In some implementations, a control system, an algorithm, or a set of machine-readable instructions may cause the control system 304 to generate and provide an input signal to a control unit of the DPU 308. The input signal may cause the DPU 308 to begin setting the downhole tool 318 by pulling an inner core rod of the downhole tool 318. The downhole tool 318 may be configured to form a pressure seal with an inner surface of the tubular 322 via the sealing elements 320. In some implementations, the sealing elements 320 may be elastomeric sealing elements. While not shown, the downhole tool 318 may include one or more anchoring devices, such as slips, to support an anchoring load applied to the downhole tool 318.

Subterranean operations may be conducted using the wireline system 300 once a drill string has been removed from a wellbore 310, though, at times, some or all of the drill string may remain in the wellbore 310 during logging with the wireline system 300. The conveyance medium 306 may include one of a wireline cable, slickline, or any other suitable hardware configured to convey the DPU 308 and downhole tool 318 to a target depth. In some implementations, the downhole tool 318 may include an isolation plug, such as the retrievable bridge plug assembly 100. However, any other downhole tool configured to anchor or form a seal within the wellbore 310 may also be used. Other downhole tools may also be possible.

Example Method of Operations

Figure 4:
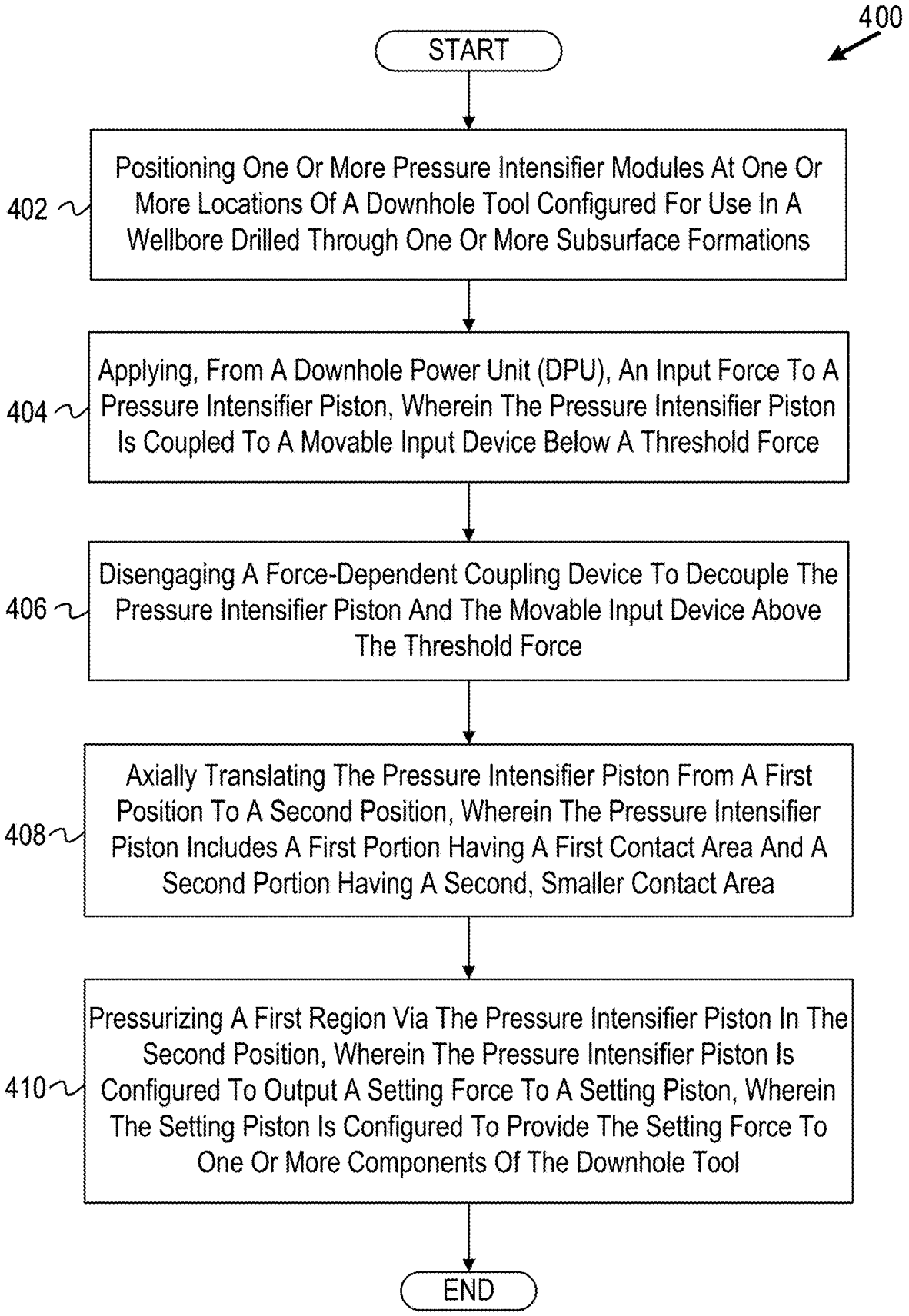
FIG. 4 is a flowchart depicting an example method of operations, according to some implementations.

FIG. 4 is a flowchart depicting an example method of operations, according to some implementations. Such operations are described with reference to FIGS. 1-3. However, such operations may be performed by other systems or components. The operations of the method 400 begin at block 402.

At block 402, the method 400 includes positioning one or more pressure intensifier modules at one or more locations of a downhole tool configured for use in a wellbore drilled through one or more subsurface formations. Flow progresses to block 404.

At block 404, the method 400 includes applying, from a downhole power unit (DPU), an input force to a pressure intensifier piston, wherein the pressure intensifier piston is coupled to a movable input device below a threshold force. For example, the movable input device may comprise the movable cylinder 202. Flow progresses to block 406.

At block 406, the method 400 includes disengaging a force-dependent coupling device to decouple the pressure intensifier piston and the movable input device above the threshold force. Flow progresses to block 408.

At block 408, the method 400 includes axially translating the pressure intensifier piston from a first position to a second position, wherein the pressure intensifier piston includes a first portion having a first contact area and a second portion having a second, smaller contact area. Flow progresses to block 410.

At block 410, the method 400 includes pressurizing a first region via the pressure intensifier piston in the second position, wherein the pressure intensifier piston is configured to output a setting force to a setting piston, wherein the setting piston is configured to provide the setting force to one or more components of the downhole tool. Flow of the method 400 ceases.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein but are to be accorded the widest scope consistent with this disclosure, the principles and the novel features disclosed herein.

Certain features that are described in this specification in the context of separate implementations also may be implemented in combination in a single implementation. Conversely, various features that are described in the context of a single implementation also may be implemented in multiple implementations separately or in any suitable sub-combination. Moreover, although features may be described as acting in certain combinations and even initially claimed as such, one or more features from a claimed combination may in some cases be excised from the combination, and the claimed combination may be directed to a sub-combination or variation of a sub-combination.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

While operations are depicted in the drawings in a particular order, this should not be understood as requiring that such operations be performed in the particular order shown or in sequential order, or that all illustrated operations be performed, to achieve desirable results. Further, the drawings may schematically depict one more example process in the form of a flow diagram. However, some operations may be omitted and/or other operations that are not depicted may be incorporated in the example processes that are schematically illustrated. For example, one or more additional operations may be performed before, after, simultaneously, or between any of the illustrated operations. In certain circumstances, multitasking and parallel operations may be advantageous. Additionally, other implementations are within the scope of the following claims. In some cases, the actions recited in the claims may be performed in a different order and still achieve desirable results.

Unless otherwise specified, use of the terms "up," "upper," "upward," "uphole," "upstream," or other like terms shall be construed as generally away from the bottom, terminal end of a well; likewise, use of the terms "down," "lower," "downward," "downhole," or other like terms shall be construed as generally toward the bottom, terminal end of the well, regardless of the wellbore orientation. Use of any one or more of the foregoing terms shall not be construed as denoting positions along a perfectly vertical axis. In some instances, a part near the end of the well may be horizontal or even slightly directed upwards. Unless otherwise specified, use of the terms "subsurface formation" or "subterranean formation" shall be construed as encompassing both areas below exposed earth and areas below earth covered by water such as ocean or fresh water.

As used herein, a phrase referring to "at least one of" a list of items refers to any combination of those items, including single members. As an example, "at least one of: a, b, or c" is intended to cover: a, b, c, a-b, a-c, b-c, and a-b-c.

EXAMPLE IMPLEMENTATIONS

Example implementations include the following:

Implementation #1: An apparatus configured for use in a wellbore drilled through one or more subsurface formations, the apparatus comprising: one or more pressure intensifier modules configured to increase an applied force of a downhole power unit (DPU) in setting a downhole tool in the wellbore, each pressure intensifier module including, a movable input device configured to provide an input force from the DPU, a pressure intensifier piston having a first portion of a first contact area and a second portion of a second, smaller contact area, wherein the pressure intensifier piston is coupled to the movable input device by a force-dependent coupling device, and a setting piston configured to provide a setting force to one or more components of the downhole tool, wherein the setting force is generated, at least in part, by the pressure intensifier piston.

Implementation #2: The apparatus of Implementation 1, wherein the force-dependent coupling device is configured to couple the movable input device and the pressure intensifier piston below a threshold force, and wherein the applied force from the DPU is approximately equal to the setting force below the threshold force.

Implementation #3: The apparatus of any one or more of Implementations 1-2, further comprising: a pressurization bore formed, at least in part, by the movable input device, wherein the pressurization bore contains a first fluid; and a first region, wherein the force-dependent coupling device is configured to decouple the movable input device and the pressure intensifier piston above a threshold force, wherein the pressure intensifier piston is configured to axially translate from a first position to a second position when decoupled from the force-dependent coupling device, wherein the second portion of the of the pressure intensifier piston is configured to move through the pressurization bore, and wherein the first fluid is pushed into the first region to pressurize the first region.

Implementation #4: The apparatus of any one or more of Implementations 1-3, wherein the setting piston is configured to axially translate via the setting force after the first region is pressurized.

Implementation #5: The apparatus of any one or more of Implementations 1-4, further comprising: one or more lock rings configured receive the setting force from the setting piston, wherein the one or more lock rings are positioned to maintain the setting force on at least one of a set of one or more anchoring devices or a set of one or more elastomeric sealing elements of the downhole tool.

Implementation #6: The apparatus of any one or more of Implementations 1-5, wherein the movable input device includes at least a first groove and a second groove, wherein the force-dependent coupling device is a collet configured to move from the first groove to the second groove above the threshold force, wherein the force-dependent coupling device in the second groove maintains the second position of the pressure intensifier piston, and wherein the pressurization of the first region is maintained via the pressure intensifier piston in the second position.

Implementation #7: The apparatus of any one or more of Implementations 1-6, wherein the pressure intensifier piston is held in place in the second position, and wherein the pressure intensifier piston in the second position is configured to maintain the setting force during a thermal cooldown of one or more elastomeric sealing elements of the downhole tool.

Implementation #8: The apparatus of any one or more of Implementations 1-7, wherein the downhole tool is a retrievable bridge plug, and wherein the one or more pressure intensifier modules are configured to be installed on the retrievable bridge plug.

Implementation #9: A system configured for use in a wellbore drilled through one or more subsurface formations, the system comprising: a downhole tool to be positioned within the wellbore, wherein the downhole tool includes one or more anchoring devices and one or more elastomeric sealing elements; a downhole power unit (DPU) configured to supply an applied force to the downhole tool to set the downhole tool within the wellbore; and one or more pressure intensifier modules configured to increase the applied force from the DPU, each pressure intensifier module including, a movable input device configured to provide an input force from the DPU, a pressure intensifier piston having a first portion of a first contact area and a second portion of a second, smaller contact area, wherein the pressure intensifier piston is coupled to the movable input device by a force-dependent coupling device, and a setting piston configured to provide a setting force to one or more components of the downhole tool, wherein the setting force is generated, at least in part, by the pressure intensifier piston.

Implementation #10: The system of Implementation 9, wherein the force-dependent coupling device is configured to couple the movable input device and the pressure intensifier piston below a threshold force, and wherein the input force from the DPU is approximately equal to the setting force below the threshold force.

Implementation #11: The system of any one or more of Implementations 9-10, further comprising: a pressurization bore formed, at least in part, by the movable input device, wherein the pressurization bore contains a first fluid; and a first region, wherein the force-dependent coupling device is configured to decouple the movable input device and the pressure intensifier piston above a threshold force, wherein the pressure intensifier piston is configured to axially translate from a first position to a second position when decoupled from the force-dependent coupling device, wherein the second portion of the of the pressure intensifier piston is configured to move through the pressurization bore, wherein the first fluid is pushed into the first region to pressurize the first region, and wherein the setting piston is configured to axially translate via the setting force after the first region is pressurized.

Implementation #12: The system of any one or more of Implementations 9-11, wherein the pressure intensifier piston is held in place in the second position, and wherein the pressure intensifier piston in the second position is configured to maintain the setting force during a thermal cooldown of the one or more elastomeric sealing elements.

Implementation #13: The system of any one or more of Implementations 9-12, further comprising: one or more lock rings configured receive the setting force from the setting piston, wherein the one or more lock rings are positioned to maintain the setting force on at least one of the one or more anchoring devices or the one or more elastomeric sealing elements of the downhole tool.

Implementation #14: The system of any one or more of Implementations 9-13, wherein the movable input device includes at least a first groove and a second groove, wherein the force-dependent coupling device is a collet configured to move from the first groove to the second groove above the threshold force, wherein the force-dependent coupling device in the second groove maintains the second position of the pressure intensifier piston, and wherein the pressurization of the first region is maintained via the pressure intensifier piston in the second position.

Implementation #15: The system of any one or more of Implementations 9-14, wherein the downhole tool is a retrievable bridge plug, and wherein the one or more pressure intensifier modules are configured to be installed on the retrievable bridge plug.

Implementation #16: A method comprising: positioning one or more pressure intensifier modules at one or more locations of a downhole tool configured for use in a wellbore drilled through one or more subsurface formations; and for each pressure intensifier module, applying, from a downhole power unit (DPU), an input force to a pressure intensifier piston, wherein the pressure intensifier piston is coupled to a movable input device below a threshold force, disengaging a force-dependent coupling device to decouple the pressure intensifier piston and the movable input device above the threshold force, axially translating the pressure intensifier piston from a first position to a second position, wherein the pressure intensifier piston includes a first portion having a first contact area and a second portion having a second, smaller contact area, and pressurizing a first region via the pressure intensifier piston in the second position, wherein the pressure intensifier piston is configured to output a setting force to a setting piston, and wherein the setting piston is configured to provide the setting force to one or more components of the downhole tool.

Implementation #17: The method of Implementation 16, further comprising: axially translating the second portion of the pressure intensifier piston through a pressurization bore, wherein axially translating the second portion of the pressure intensifier piston through the pressurization bore pressurizes the first region.

Implementation #18: The method of any one or more of Implementations 16-17, wherein the setting force is greater than the input force.

Implementation #19: The method of any one or more of Implementations 16-18, further comprising: locking the pressure intensifier piston in the second position, wherein the pressure intensifier piston in the second position is configured to maintain the setting force during a thermal cooldown of one or more elastomeric sealing elements of the downhole tool.

Implementation #20: The method of any one or more of Implementations 16-19, wherein the downhole tool is a retrievable bridge plug, and wherein the one or more pressure intensifier modules are configured to be installed on the retrievable bridge plug.

What is claimed is:

1. An apparatus configured for use in a wellbore drilled through one or more subsurface formations, the apparatus comprising:

one or more pressure intensifier modules configured to increase an applied force of a downhole power unit (DPU) in setting a downhole tool in the wellbore, each pressure intensifier module including, a movable input device configured to provide an input force from the DPU, a pressure intensifier piston having a first portion of a first contact area and a second portion of a second, smaller contact area, wherein the pressure intensifier piston is coupled to the movable input device by a force-dependent coupling device, and a setting piston configured to provide a setting force to one or more components of the downhole tool, wherein the setting force is generated, at least in part, by the pressure intensifier piston.

2. The apparatus of claim 1, wherein the force-dependent coupling device is configured to couple the movable input device and the pressure intensifier piston below a threshold force, and wherein the applied force from the DPU is approximately equal to the setting force below the threshold force.

3. The apparatus of claim 1, further comprising:

a pressurization bore formed, at least in part, by the movable input device, wherein the pressurization bore contains a first fluid; and a first region, wherein the force-dependent coupling device is configured to decouple the movable input device and the pressure intensifier piston above a threshold force, wherein the pressure intensifier piston is configured to axially translate from a first position to a second position when decoupled from the force-dependent coupling device, wherein the second portion of the of the pressure intensifier piston is configured to move through the pressurization bore, and wherein the first fluid is pushed into the first region to pressurize the first region.

4. The apparatus of claim 3, wherein the setting piston is configured to axially translate via the setting force after the first region is pressurized.

5. The apparatus of claim 4, further comprising:

one or more lock rings configured receive the setting force from the setting piston, wherein the one or more lock rings are positioned to maintain the setting force on at least one of a set of one or more anchoring devices or a set of one or more elastomeric sealing elements of the downhole tool.

6. The apparatus of claim 3, wherein the movable input device includes at least a first groove and a second groove, wherein the force-dependent coupling device is a collet configured to move from the first groove to the second groove above the threshold force, wherein the force-dependent coupling device in the second groove maintains the second position of the pressure intensifier piston, and wherein the pressurization of the first region is maintained via the pressure intensifier piston in the second position.

7. The apparatus of claim 3, wherein the pressure intensifier piston is held in place in the second position, and wherein the pressure intensifier piston in the second position is configured to maintain the setting force during a thermal cooldown of one or more elastomeric sealing elements of the downhole tool.

8. The apparatus of claim 1, wherein the downhole tool is a retrievable bridge plug, and wherein the one or more pressure intensifier modules are configured to be installed on the retrievable bridge plug.

9. A system configured for use in a wellbore drilled through one or more subsurface formations, the system comprising:

a downhole tool to be positioned within the wellbore, wherein the downhole tool includes one or more anchoring devices and one or more elastomeric sealing elements;

a downhole power unit (DPU) configured to supply an applied force to the downhole tool to set the downhole tool within the wellbore; and one or more pressure intensifier modules configured to increase the applied force from the DPU, each pressure intensifier module including, a movable input device configured to provide an input force from the DPU, a pressure intensifier piston having a first portion of a first contact area and a second portion of a second, smaller contact area, wherein the pressure intensifier piston is coupled to the movable input device by a force-dependent coupling device, and a setting piston configured to provide a setting force to one or more components of the downhole tool, wherein the setting force is generated, at least in part, by the pressure intensifier piston.

10. The system of claim 9, wherein the force-dependent coupling device is configured to couple the movable input device and the pressure intensifier piston below a threshold force, and wherein the input force from the DPU is approximately equal to the setting force below the threshold force.

11. The system of claim 9, further comprising:

a pressurization bore formed, at least in part, by the movable input device, wherein the pressurization bore contains a first fluid; and a first region, wherein the force-dependent coupling device is configured to decouple the movable input device and the pressure intensifier piston above a threshold force, wherein the pressure intensifier piston is configured to axially translate from a first position to a second position when decoupled from the force-dependent coupling device, wherein the second portion of the of the pressure intensifier piston is configured to move through the pressurization bore, wherein the first fluid is pushed into the first region to pressurize the first region, and wherein the setting piston is configured to axially translate via the setting force after the first region is pressurized.

12. The system of claim 11, wherein the pressure intensifier piston is held in place in the second position, and wherein the pressure intensifier piston in the second position is configured to maintain the setting force during a thermal cooldown of the one or more elastomeric sealing elements.

13. The system of claim 11, further comprising:

one or more lock rings configured receive the setting force from the setting piston, wherein the one or more lock rings are positioned to maintain the setting force on at least one of the one or more anchoring devices or the one or more elastomeric sealing elements of the downhole tool.

14. The system of claim 11, wherein the movable input device includes at least a first groove and a second groove, wherein the force-dependent coupling device is a collet configured to move from the first groove to the second groove above the threshold force, wherein the force-dependent coupling device in the second groove maintains the second position of the pressure intensifier piston, and wherein the pressurization of the first region is maintained via the pressure intensifier piston in the second position.

15. The system of claim 9, wherein the downhole tool is a retrievable bridge plug, and wherein the one or more pressure intensifier modules are configured to be installed on the retrievable bridge plug.

16. A method comprising:

positioning one or more pressure intensifier modules at one or more locations of a downhole tool configured for use in a wellbore drilled through one or more subsurface formations; and for each pressure intensifier module, applying, from a downhole power unit (DPU), an input force to a pressure intensifier piston, wherein the pressure intensifier piston is coupled to a movable input device below a threshold force, disengaging a force-dependent coupling device to decouple the pressure intensifier piston and the movable input device above the threshold force, axially translating the pressure intensifier piston from a first position to a second position, wherein the pressure intensifier piston includes a first portion having a first contact area and a second portion having a second, smaller contact area, and pressurizing a first region via the pressure intensifier piston in the second position, wherein the pressure intensifier piston is configured to output a setting force to a setting piston, and wherein the setting piston is configured to provide the setting force to one or more components of the downhole tool.

17. The method of claim 16, further comprising:

axially translating the second portion of the pressure intensifier piston through a pressurization bore, wherein axially translating the second portion of the pressure intensifier piston through the pressurization bore pressurizes the first region.

18. The method of claim 16, wherein the setting force is greater than the input force.

19. The method of claim 16, further comprising:

locking the pressure intensifier piston in the second position, wherein the pressure intensifier piston in the second position is configured to maintain the setting force during a thermal cooldown of one or more elastomeric sealing elements of the downhole tool.

20. The method of claim 16, wherein the downhole tool is a retrievable bridge plug, and wherein the one or more pressure intensifier modules are configured to be installed on the retrievable bridge plug.

* * * * *